US010081977B2

(12) United States Patent
Shelley

(10) Patent No.: US 10,081,977 B2
(45) Date of Patent: Sep. 25, 2018

(54) AUTOMATIC DOOR OPENING AND CLOSING DEVICE

(71) Applicant: Emery Shelley, Oconomowoc, WI (US)

(72) Inventor: Emery Shelley, Oconomowoc, WI (US)

( * ) Notice: Subject to any disclaimer, the term of this patent is extended or adjusted under 35 U.S.C. 154(b) by 0 days.

(21) Appl. No.: 15/681,959

(22) Filed: Aug. 21, 2017

(65) Prior Publication Data

US 2018/0058130 A1 Mar. 1, 2018

Related U.S. Application Data

(60) Provisional application No. 62/378,763, filed on Aug. 24, 2016.

(51) Int. Cl.
*E05F 15/624* (2015.01)
*E05F 15/641* (2015.01)
*E05F 15/611* (2015.01)

(52) U.S. Cl.
CPC ..... *E05F 15/624* (2015.01); *E05F 15/611* (2015.01); *E05F 15/641* (2015.01)

(58) Field of Classification Search
CPC ..... E05F 15/641; E05F 15/624
See application file for complete search history.

(56) References Cited

U.S. PATENT DOCUMENTS 1,631,416 A * 6/1927 Howard ..... E01F 13/06 49/107
1,694,431 A * 12/1928 Russell ..... E05F 15/624 49/358
3,606,699 A * 9/1971 Robinson, Jr. ..... E05F 15/635 49/264
4,065,878 A * 1/1978 Tsugane ..... E05F 15/624 49/360
4,520,592 A * 6/1985 Holloway ..... E05F 15/624 49/25
4,672,773 A * 6/1987 Bilt ..... E05F 15/641 49/139
4,754,572 A * 7/1988 Bilt ..... E05F 15/635 49/139
5,170,585 A * 12/1992 Wen ..... H02J 7/0042 49/358
5,448,952 A * 9/1995 Hung ..... E05F 15/635 104/249
5,583,405 A 12/1996 Sai et al.
(Continued)

*Primary Examiner* — Justin B Rephann
(74) *Attorney, Agent, or Firm* — Patent File, LLC; Bradley C. Fach; Steven R. Kick

(57) ABSTRACT

An automatic door opening and closing device include a housing which may contain a control unit. A motor may be in electronic communication with the control unit, and a wheel may be coupled to the motor so that the motor may be operable to rotate the wheel in a clockwise direction and in a counter clockwise direction. A chassis may be configured to couple the motor to a door so that the wheel is in contact with a ground surface below the door. The motor may be operable to rotate the wheel clockwise across the ground surface to motivate the door in a first direction, and the motor may be operable to rotate the wheel counterclockwise across the ground surface to motivate the door in a second direction. By motivating the door in either the first direction or the second direction, the device may be configured to move the door into, out of, and between the open and closed positions.

16 Claims, 12 Drawing Sheets

(56) References Cited

U.S. PATENT DOCUMENTS

| | | | | |
|---|---|---|---|---|
| 5,881,497 | A | 3/1999 | Borgardt | |
| 6,176,039 | B1 * | 1/2001 | Craig | E05F 15/43 49/197 |
| 6,581,332 | B1 * | 6/2003 | Kim | E05F 15/635 49/358 |
| 6,967,587 | B2 | 11/2005 | Snell et al. | |
| 7,021,005 | B1 * | 4/2006 | Curry | E05F 15/624 49/358 |
| 7,213,369 | B2 * | 5/2007 | Freeman | G10L 15/26 49/358 |
| 8,169,317 | B2 | 5/2012 | Lemerand et al. | |
| 9,725,941 | B2 * | 8/2017 | Van Tassell, III | E05F 15/641 |
| 2004/0103584 | A1 * | 6/2004 | Freeman | G10L 15/26 49/334 |
| 2006/0144529 | A1 * | 7/2006 | Hemphill | E05F 15/635 160/188 |
| 2007/0186480 | A1 * | 8/2007 | Freeman | G10L 15/26 49/358 |
| 2010/0180506 | A1 * | 7/2010 | Halfon | E05F 17/00 49/118 |
| 2012/0272576 | A1 * | 11/2012 | Van Tassell, III | E05F 15/60 49/70 |
| 2012/0304541 | A1 * | 12/2012 | Goodman | B60B 33/0039 49/358 |
| 2013/0145692 | A1 | 6/2013 | Laird et al. | |
| 2013/0318878 | A1 * | 12/2013 | Manseder | E05F 15/603 49/358 |
| 2013/0326960 | A1 * | 12/2013 | Manseder | E05F 15/624 49/358 |

* cited by examiner

AUTOMATIC DOOR OPENING AND CLOSING DEVICE

CROSS REFERENCE TO RELATED APPLICATIONS

This application claims priority to and the benefit of the filing date of U.S. Provisional Application No. 62/378,763, filed on Aug. 24, 2016, entitled "REMOTE CONTROL INTERIOR MULTI-DOOR OPERATING SYSTEM", which is hereby incorporated by reference in its entirety.

FIELD OF THE INVENTION

This patent specification relates to the field of devices for opening and closing of a door. More specifically, this patent specification relates to a device governing the opening and closing of a door.

BACKGROUND

As a caregiver of an elderly person with an assistive walking device (commonly referred to as a walker), we asked what we could do to make her life easier. She requested an easier way for her to open and close the doors so that she could get through them by herself. We researched the most common reason for falls of the elderly and handicapped and found that trying to maneuver beyond a current level of functioning was a major problem. It was apparent that backing up, and one handed operation of an assistive walking device, (Walker, cane or crutches) is a very unsafe situation. Opening a door in a wheelchair is also a difficult maneuver and often requires unsafe reaching forward. Having doors for bedroom, bathroom, etc. open upon approach, and being able to continue in a forward motion and close without turning around, would greatly increase safety and convenience.

Prior art has only approached various permanently fixed door and frame mounted devices for various aspects of operating doors such as patent awarded to Albrecht in 1991, U.S. Pat. No. 5,040,331 A. None have addressed the need for remote controlled door operation and a single-point mounting system that is non-marring, semi-permanent door attachments in pivotal hinged doors. Many inventions, such as those disclosed in U.S. Pat. No. 5,727,348 filed by Arnel et al, address only the remote closing of a door. Many others, such as those disclosed in U.S. Pat. No. 5,881,497 filed by Borhardt et all and U.S. Pat. No. 5,930,954 filed by Hebda et al, address opening by fixed frame and door mounting devices, using mechanically mounted devices on both the door and doorframe or wall, as well as, using timing devices for closing. Other inventions, such as those disclosed in U.S. Pat. No. 6,553,717 filed by Stanley Works, use the traditional overhead two point mount to the top of the door and the doorframe as frequently seen in commercial door closing, again only allowing the operator to fully open or fully close the door. The most common patents found in this field are for the use of remote controlled door opening and closing for overhead garage door operation. There are many door closers that are single function such as disclosed in WO1998044230 A1 which is portable and can be operated from a remote location. These single function operators, however do not address the needs of a feeble person who would like to open their door partially, to let the dog in, and then close it again from a chair.

There are many known door opening devices used for opening and closing of swing doors wherein an operation device may be mounted in close proximity to the door frame and coupled to the swing door to control the operation of the door. In U.S. Pat. No. 4,727,679 awarded to Stanley works, and EP 1671292 A4 awarded to Sanidoor LLC., there are disclosed systems for automatically controlling the operation of a swing door which includes an electronic controller responsive to various input signals such that initiation of an opening sequence may be accomplished by conventional actuation means such as floor mats, hand wave detection, voice command or other conventional systems. After the door is opened, closing thereof occurs after a short delay rather than using input from the individual. This and other systems utilize a transmission system include pulley drive shafts, idler shafts, and linkage systems using a crank arm. Most of the prior art illustrate door openers used in industrial door opening devices which are commonly used at retail stores or other commercial areas and must operate from a 120 volt line source and effects only fully open or fully closed doors by actuation, command or timer.

There are also other systems, which provide remotely controlled, opening and closing of doors, windows or the like such as found in Tolson's U.S. Pat. No. 3,337,992. In this patent, a remote sensing device is utilized to actuate a mechanical door opening or closure system in response to various selected physical conditions or other criteria. This system includes programming means to control the overall operation of the system enabling various functions to be selectively achieved. The system is complicated and cumbersome to utilize effectively, and may be prone to breakdown and inefficient operation.

There is a great need for a device to increase the safety of temporarily or permanently handicapped individuals while navigating with assistive walking devices and wheelchairs, through doors and to provide free access of swing doors. To be an effective door opener/closer for this population the device should meet certain standards: 1) Scalable multi-door operation system. The system needs to be able to operate one door or up to six or more doors from a portable hand held or mountable remote control. 2) It is important that the remote control opening and closing device be easily installed, with a semi permanent system with no marring or drilling into the door, so as to enable retrofitting to an existing door. 3) Utilize a single point mounting system, rather than two points connected with an articulating arm, for ease of installation and flexibility to re-mount in any swing door location. 4) The handheld or mounted remote control device must be simple to use and easily operated by elderly and handicapped individuals. 5) The activating signals used should be of the frequency to prevent accidental opening or closing from occurring based upon signals generated from other remote devices. 6) the device must be easily opened and closed manually without adaptation, for emergency egress and convenience of non-handicapped access. 7) It is also desired that the opening and closing system be cost effective and convenient to use. None of the current art meets all these standards.

BRIEF SUMMARY OF THE INVENTION

An automatic door opening and closing device is provided. The device may be configured to move a door in a first direction, move the door in a second direction, and to stop the movement of the door thereby enabling the device to open the door, close the door, or stop the door. In some embodiments, the device may include a housing which may contain a control unit. A motor may be in electronic communication with the control unit, and a wheel may be coupled to the motor so that the motor may be operable to rotate the wheel in a clockwise direction and in a counter clockwise direction. A chassis may be configured to couple the motor to a door so that the wheel is in contact with a ground surface 600 below the door. The motor may be operable to rotate the wheel clockwise across the ground surface to motivate the door in a first direction, and the motor may be operable to rotate the wheel counterclockwise across the ground surface to motivate the door in a second direction. By motivating the door in either the first direction or the second direction, the device may be configured to move the door into, out of, and between the open and closed positions.

In further embodiments, the wheel may be movably coupled to the chassis so that the wheel may move relative the door to which the device is coupled.

In further embodiments, the device may include or may be in communication with a remote control configured to generate a wireless signal. The control unit may then control the motor to rotate the wheel when the device receives the wireless signal from the remote control.

In yet further embodiments, the device may be in communication with a client device, such as a smart phone, that is configured to generate a wireless signal. The control unit may then control the motor to rotate the wheel when the device receives the wireless signal from the client device.

In still further embodiments, the device may include or may be in communication with a translator. A translator may receive a wireless signal from a client device and then output another wireless signal to the device to enable communication between the client device and the device if they operate on different frequencies or with different communication protocols. Upon receiving a wireless signal from the client device via a translator, the control unit may then control the motor to rotate the wheel when the radio module receives the wireless signal from the translator.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
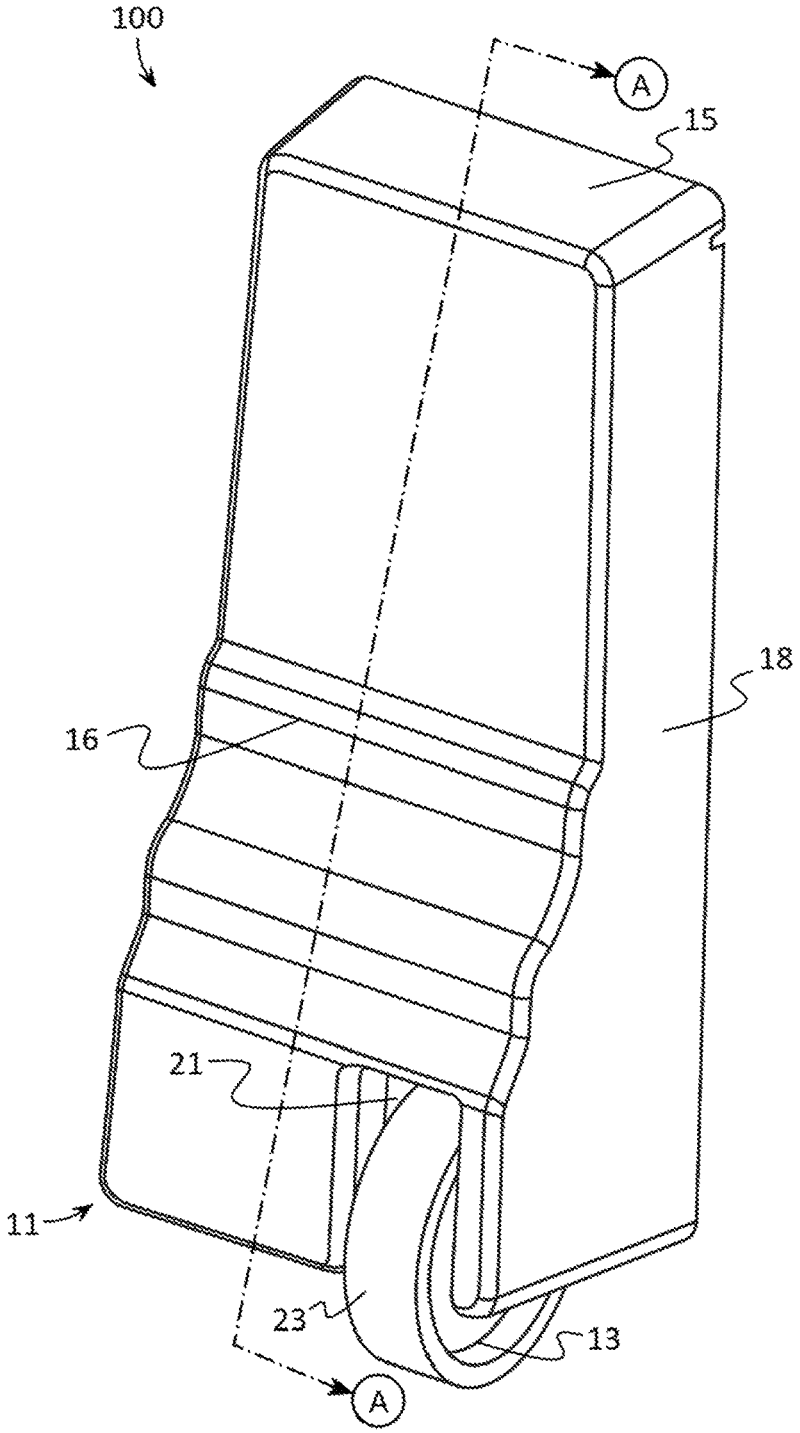
FIG. 1 depicts a front perspective view of an example of an automatic door opening and closing device according to various embodiments described herein.
Figure 2:
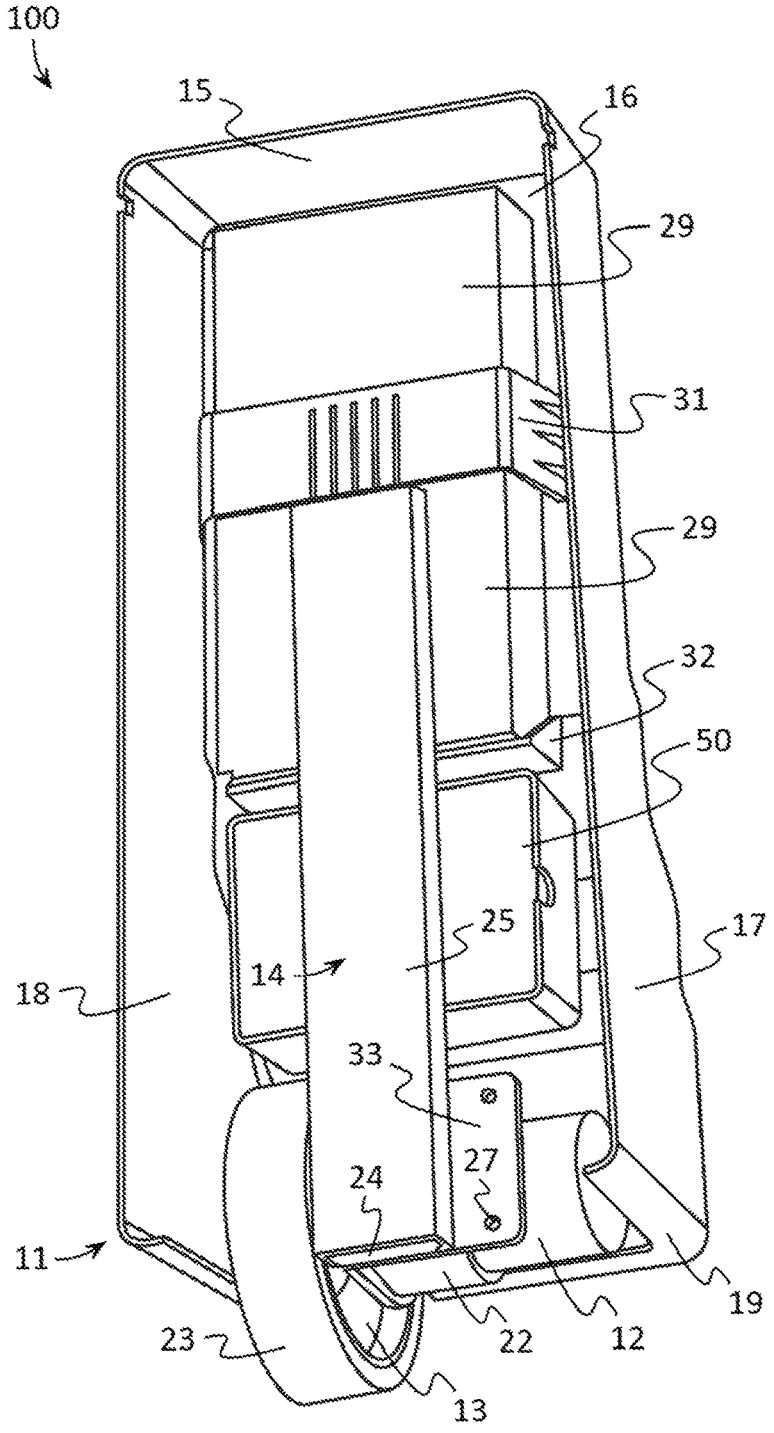
FIG. 2 illustrates a rear perspective view of an example of an automatic door opening and closing device according to various embodiments described herein.
Figure 3:
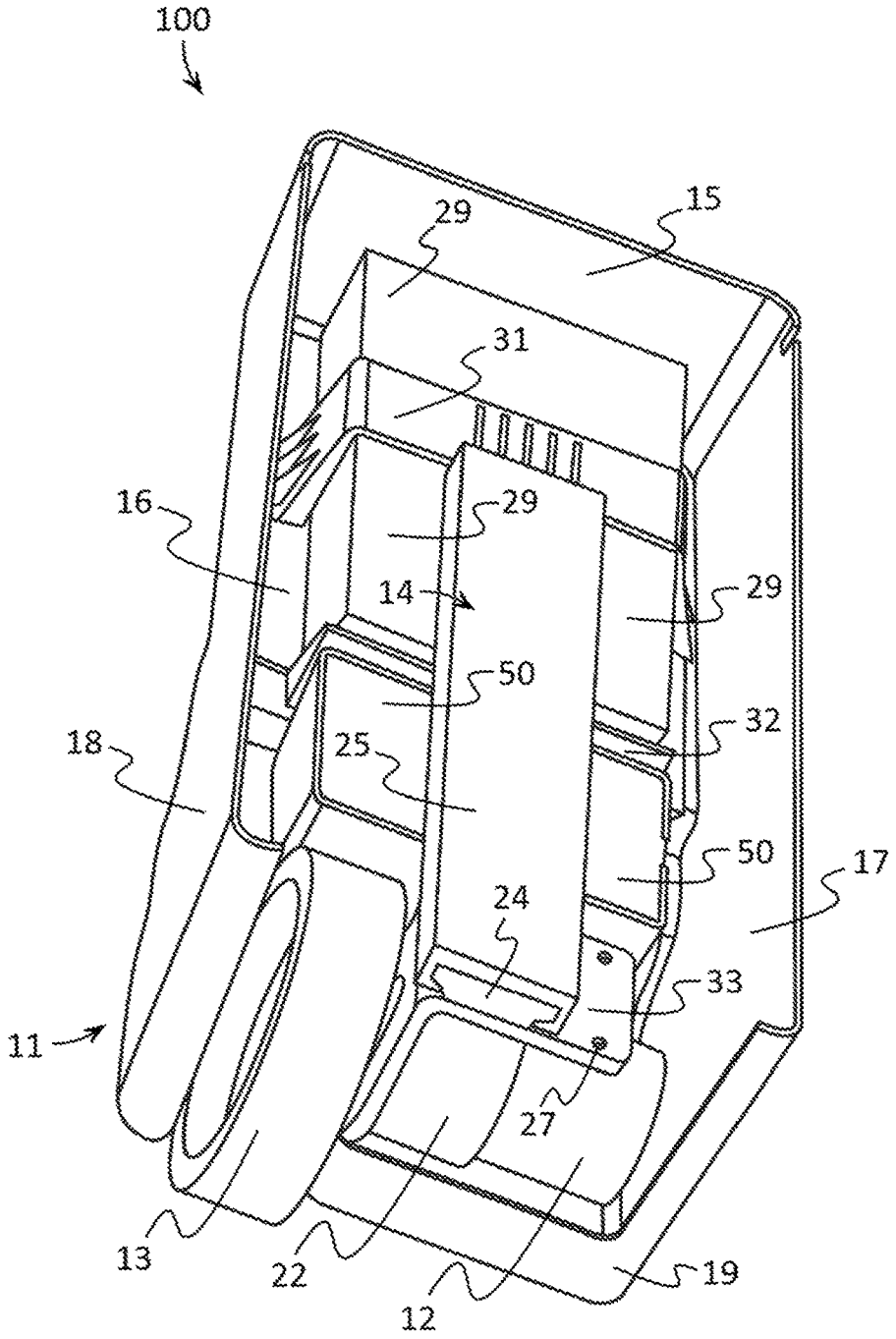
FIG. 3 shows a bottom rear perspective view of an example of an automatic door opening and closing device according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

New devices for opening and closing of a door are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 10:
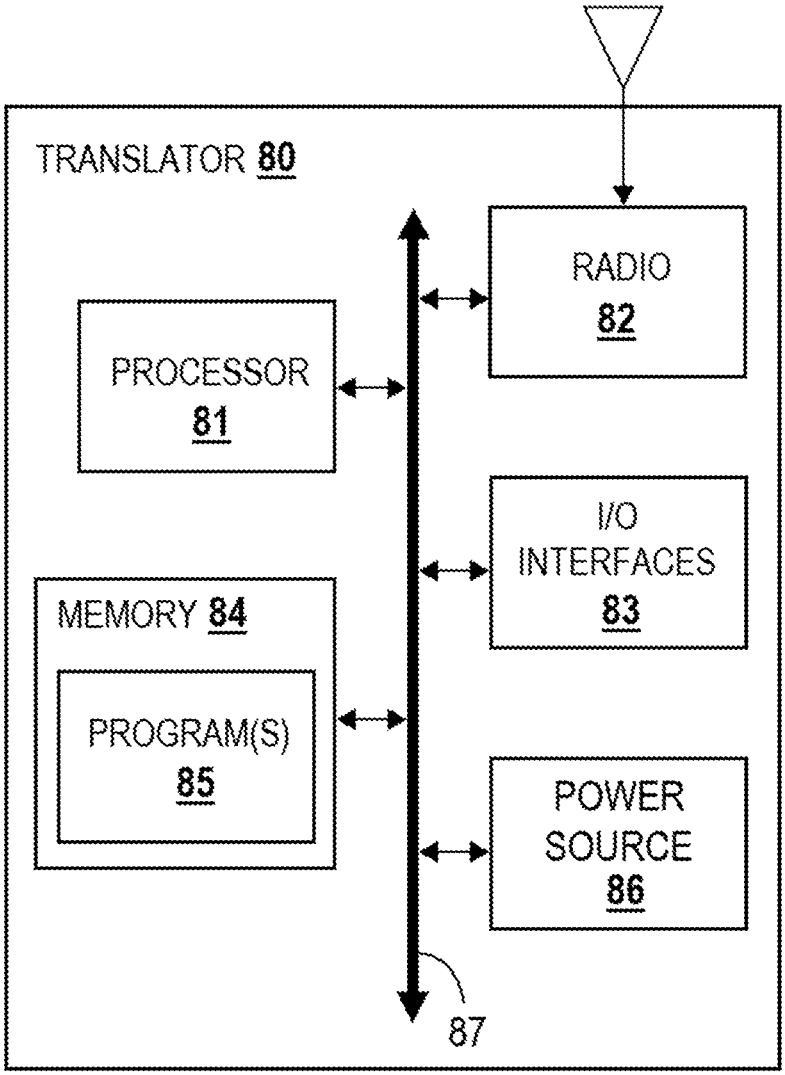
FIG. 10 depicts a block diagram of an example of a translator according to various embodiments described herein.

The present invention will now be described by example and through referencing the appended figures representing preferred and alternative embodiments. FIGS. 1-5 illustrate examples of an automatic door opening and closing device ("the device") 100 according to various embodiments. In some embodiments, the device 100 may comprise a housing 11 which may contain a control unit 50. A motor 12 may be in electronic communication with the control unit 50, and a wheel 13 may be coupled to the motor 12 so that the motor 12 may be operable to rotate the wheel 13 in a clockwise direction and in a counter clockwise direction. A chassis 14 may be configured to couple the motor 12 to a door 500 (FIGS. 10 and 11) so that the wheel 13 is in contact with a ground surface 600 (FIG. 10). The motor 12 may be operable to rotate the wheel 13 clockwise across the ground surface 600 to motivate the door 500 in a first direction, and the motor 12 may be operable to rotate the wheel 13 counterclockwise across the ground surface 600 to motivate the door in a second direction. By motivating the door 500 in either the first direction or the second direction, the device 100 may be configured to move the door 500 into, out of, and between the open and closed positions.

A housing 11 may be configured in any shape or size to preferably cover one or more elements of the device 100 such as the motor 12 and the control unit 50. Generally, the housing 11 may be shaped to allow all or portions of the wheel 13 to extend past the bottom of the housing 11 so that the wheel 13 may be positioned proximate with the bottom of a door 500 and in contact with the ground surface 600 below the door 500. Optionally, a housing 11 may comprise a top wall 15, front wall 16, a first side wall 17, a second side wall 18, and/or a bottom wall 19. In some embodiments, a bottom wall 19, front wall 16, and/or any other portion of the housing 11 may comprise a wheel aperture 21 which may allow portions of the wheel 13 to extend through those portions of the housing 11. A housing 11 may be made from or comprise a substantially rigid material such as steel alloys, aluminum, any other type of metal or metal alloy, various types of hard plastics, such as polyethylene (PE), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, or any other material including combinations of materials.

The device 100 may comprise one or more motors 12 which may be coupled to the wheel 13 and which may be operable to rotate the wheel 13 in a clockwise direction and in a counter clockwise direction. In some embodiments, the motor 12 may comprise a DC reversible motor with a shaft spindle 34 to which the wheel 13 may be coupled to provide the axis of rotation for the wheel 13. In other embodiments, a motor 12 may comprise a brushed DC motor, brushless DC motor, switched reluctance motor, universal motor, AC polyphase squirrel-cage or wound-rotor induction motor, AC SCIM split-phase capacitor-start motor, AC SCIM split-phase capacitor-run motor, AC SCIM split-phase auxiliary start winding motor, AC induction shaded-pole motor, wound-rotor synchronous motor, hysteresis motor, synchronous reluctance motor, pancake or axial rotor motor, stepper motor, or any other type of motor. In alternative embodiments, a motor 12 may comprise a hydraulic motor such as a Gear and vane motor, Gerotor motor, Axial plunger motors, Radial piston motors, or any other hydraulically motivated motor.

In some embodiments, the device 100 may comprise a transmission 22 which may transfer motion from the motor 12 to the wheel 13. A transmission 22 may comprise any mechanical arrangement which provides controlled application of power, such as a gearbox that uses gears and gear trains to provide speed and torque conversions from a rotating power source to another device. In some embodiments, a transmission 22 may comprise a single stage gear reducer, a multi-stage gear reducer, or any other type of simple transmission, multi-ration transmission, clutched transmission, continuously variable transmission, infinitely variable transmission, electric variable transmission, Non-direct transmission, or any other type of transmission. In preferred embodiments, a transmission 22 may be configured to resist rotation of the wheel 13 not caused by the motor 12. For example, a transmission 22 may comprise a single stage gear reducer which may be operable to provide a mechanical advantage to the motor 12 to turn the wheel but which may provide a mechanical disadvantage to moving the motor 12 via the wheel 13. A transmission 22 and/or a motor 13 may be coupled, optionally movably coupled, to the chassis 14 or other element of the device 100 with one or more motor mounts 33, such as an elbow bracket or any other coupling method.

In some embodiments, the device 100 may comprise one or more wheels 13 which may transmit the motive force from the motor 12 to the ground surface 600 (FIG. 10) below the door 500 (FIGS. 10 and 11) to which the device 100 is coupled. In preferred embodiments, a wheel 13 may comprise a circular component that is intended to rotate in a clockwise direction and in a counterclockwise direction on an axis such as which may be provided by an axle bearing.

In preferred embodiments, a wheel 13 may comprise a resilient material 23 which may provide a non-slip surface for contacting the ground surface 600 (FIG. 10) below the door 500 (FIGS. 10 and 11) to which the device 100 is coupled. In further embodiments, a resilient material 23 may comprise a Shore Hardness or equivalent of between 20 A to 95 A, and preferably 45 A to 65 A. In some embodiments, a resilient material may be a natural and/or synthetic rubber material, which is flexible to allow slight deformation and resilient so as to return to its original shape after deformation. Natural rubber materials may include latex rubber, forms of the organic compound isoprene, such as polyisoprene, and the like. Synthetic rubber materials may include Polyacrylate Rubber, Ethylene-acrylate Rubber, Polyester Urethane, Bromo Isobutylene Isoprene, Polybutadiene, Chloro Isobutylene Isoprene, Polychloroprene, Chlorosulphonated Polyethylene, Epichlorohydrin, Ethylene Propylene, Ethylene Propylene Diene Monomer, Polyether Urethane, Perfluorocarbon Rubber, Fluoronated Hydrocarbon, Fluoro Silicone, Fluorocarbon Rubber, Hydrogenated Nitrile Butadiene, Polyisoprene, Isobutylene Isoprene Butyl, Acrylonitrile Butadiene, Polyurethane, Styrene Butadiene, Styrene Ethylene Butylene Styrene Copolymer, Polysiloxane, Vinyl Methyl Silicone, Acrylonitrile Butadiene Carboxy Monomer, Styrene Butadiene Carboxy Monomer, Thermoplastic Polyether-ester, Styrene Butadiene Block Copolymer, Styrene Butadiene Carboxy Block Copolymer, and the like. In other embodiments, a resilient material may comprise various types of plastic such as polytetrafluoroethylene (PTFE), polyethylene terephthalate (PET), high-density polyethylene (HDPE), polyvinyl chloride (PVC), polypropylene (PP), Polystyrene (PS), Polycarbonate (PC), low density polyethylene (LDPE), Polyoxymethylene (POM), Acrylonitrile butadiene styrene (ABS), Polyethylene/Acrylonitrile Butadiene Styrene (PE/ABS), Polycarbonate/Acrylonitrile Butadiene Styrene (PC/ABS), Ultra High Molecular Weight polyethylene, Polyurethanes (PU), Polyamides (PA), or any other suitable flexible natural or synthetic material including combinations of materials.

The device 100 may comprise a chassis 14 which may be configured to couple the motor 12 to a door 500 (FIGS. 10 and 11) so that the wheel 13 is in contact with a ground surface 600 (FIG. 10). In some embodiments, the chassis 14 may be removably coupled to the door 500 with removable adhesive, removable adhesive tape, removable fasteners, such as hook and loop type or Velcro® fasteners, magnetic type fasteners, threaded type fasteners, sealable tongue and groove fasteners, snap fasteners, clip type fasteners, clasp type fasteners, ratchet type fasteners, or any other removable coupling method. In other embodiments, the chassis 14 may be bonded, riveted, or otherwise coupled to a door 500 in a substantially non-removable manner.

In some embodiments, a chassis 14 may be integrally formed with the housing 11. In other embodiments, a housing 11 may function as a chassis 14. In preferred embodiments, the chassis 14 may be coupled to a door 500 and one or more elements of the device 100 may be coupled to the chassis 14. A chassis 14 may be of any shape or size and preferably made from or comprise a substantially rigid material. In further preferred embodiments, one or more elements of the device 100, such as a motor 12, a wheel 13, and a transmission 22, may be movably coupled to the chassis 14 so that the elements may be movable relative to one or more portions of the chassis 14.

Figure 4:
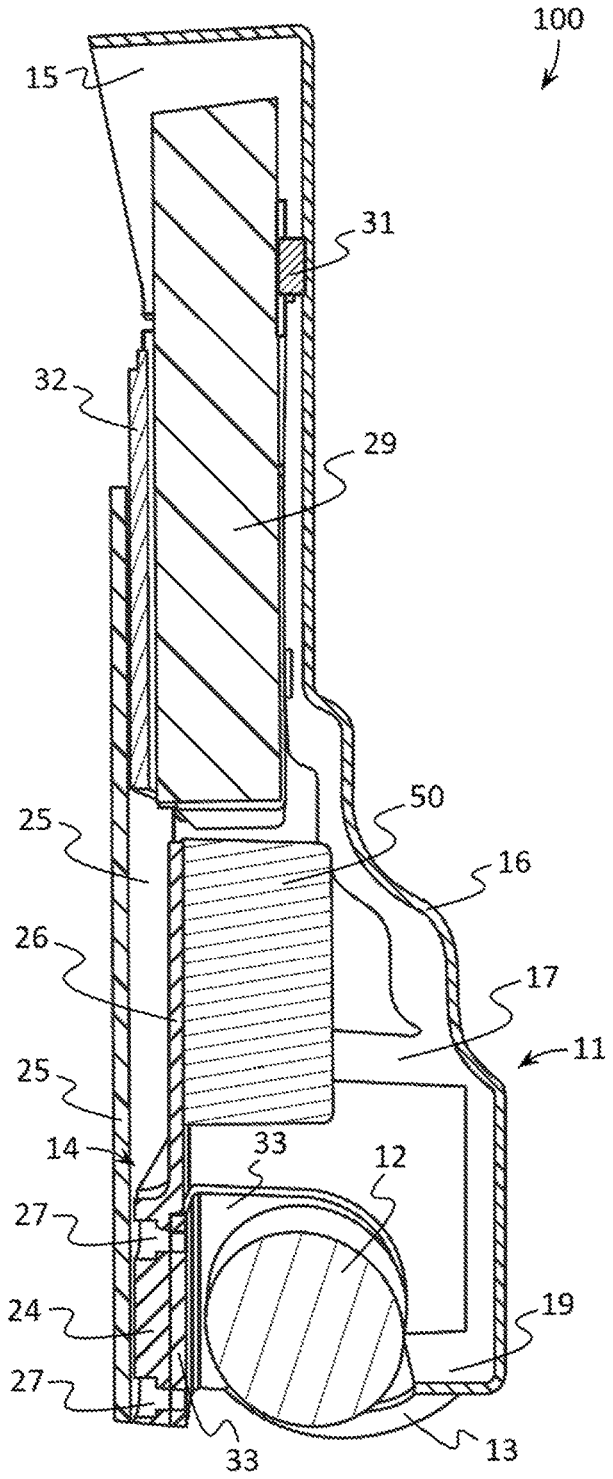
FIG. 4 depicts a sectional, through line A-A shown in FIG. 1, elevation view of an example of an automatic door opening and closing device with a wheel moved relatively closer to portions of the housing according to various embodiments described herein.
Figure 5:
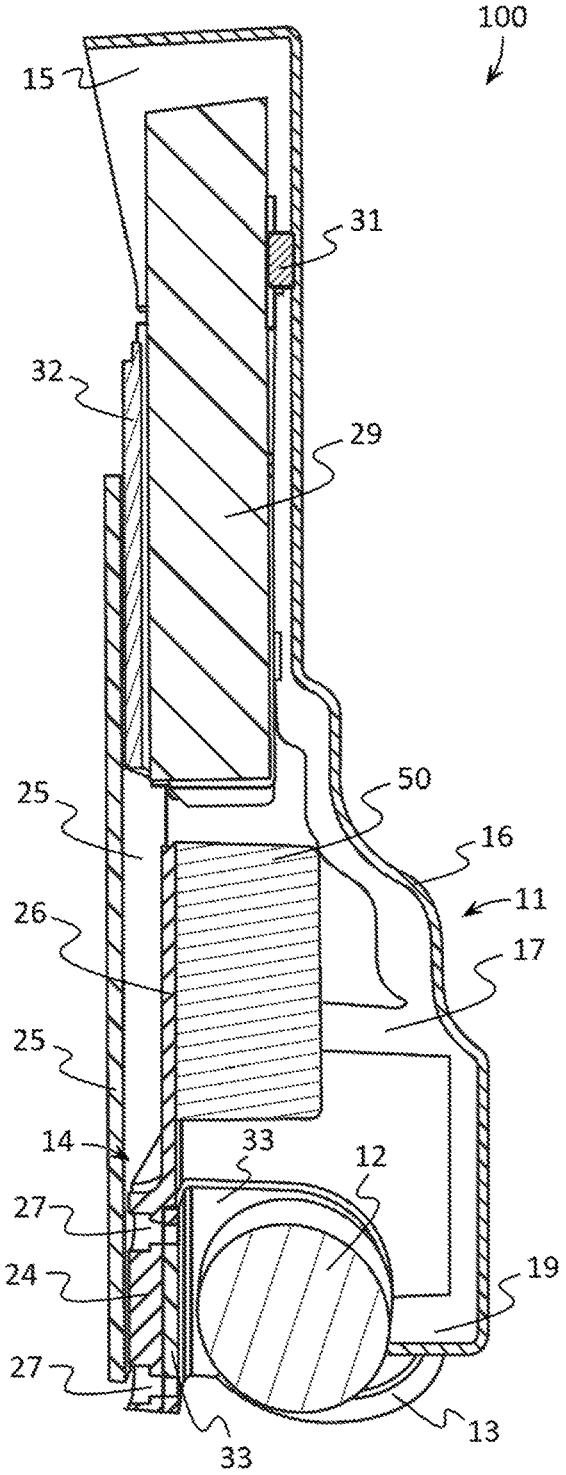
FIG. 5 illustrates a sectional, through line A-A shown in FIG. 1, elevation view of an example of an automatic door opening and closing device with a wheel moved relatively farther from portions of the housing according to various embodiments described herein.
Figure 6:
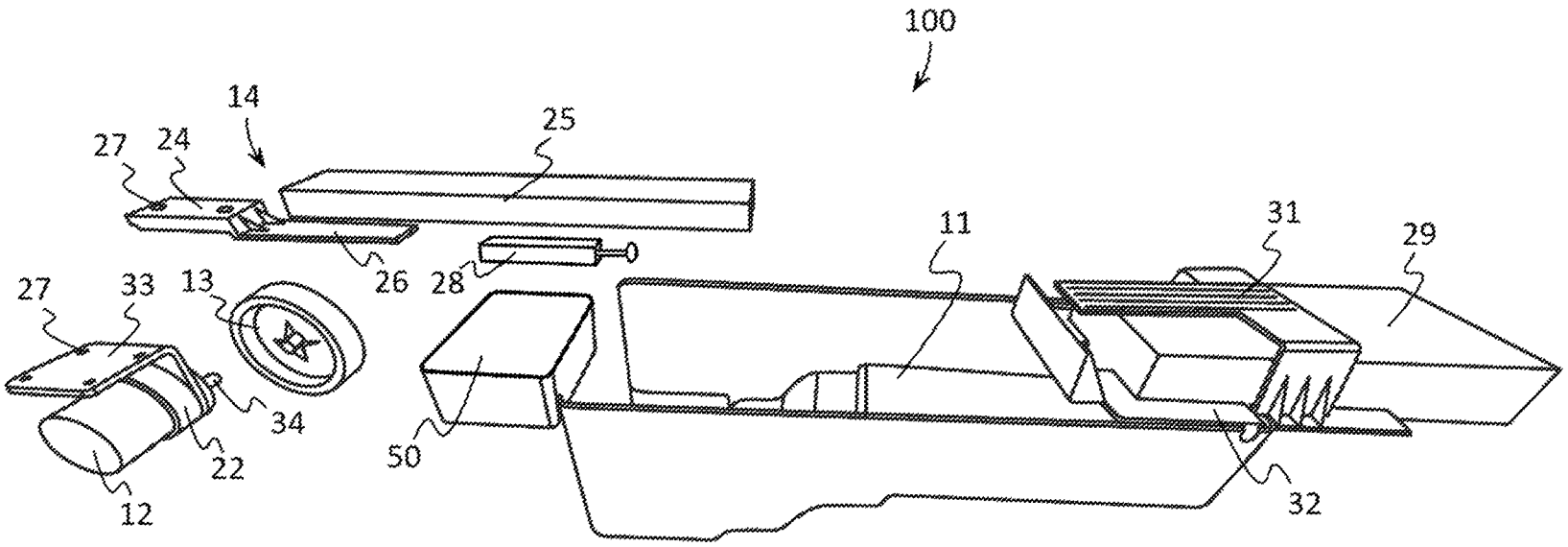
FIG. 6 shows perspective exploded view of an example of an automatic door opening and closing device according to various embodiments described herein.

In preferred embodiments, the motor 12 and/or wheel 13 may be movably coupled to the chassis 14 as shown by FIG. 4 in which the wheel 13 is relatively closer to the top wall 15 and FIG. 5 in which the wheel 13 is relatively farther from the top wall 15. By being movably coupled to the chassis 14 the motor 12 and/or wheel 13 may be afforded amount of travel so that the motor 12 and/or wheel 13 may move relative to portions of the chassis 14 which are coupled to a door 500. A motor 12 and/or wheel 13 may be movably coupled to the chassis 14 with any type of movable linkages or suspension, preferably having a tensioner 28 which may be configured to tension one or more movable linkages and, therefore, the wheel 13 into contact with the floor surface 600 that is below the door 500 to which the device 100 is coupled.

In still further preferred embodiments, the chassis 14 may comprise a slide 24 and a channel 25, and the slide 24 may be movably coupled to or within a channel 25 so that the channel 25 and slide 24 may function as a movable linkage or suspension. The channel 25 may be coupled to the door 500 and one or more elements of the device 100, such as a motor 12, a wheel 13, and a transmission 22, may be coupled to the slide 24. Portions of the slide 24, such as a tongue 26, may be movably coupled within or to the channel 25 to allow the tongue 26 to slide generally up and down the channel 25 while the device 100 is coupled to a door 500. In this manner the wheel 13 may be allowed to travel up and down over carpet, rugs, pencils, small toys, and other small objects frequently found on the floors of buildings by being allowed a distance of travel provided by the distance the tongue 26 may slide generally up and down the channel 25. Optionally, the weight of the one or more elements of the device 100, such as a motor 12, a wheel 13, and a transmission 22, which are coupled to the slide 24 may serve to force the wheel 13 into contact with the ground surface 600 that is below the door 500 to which the device 100 is coupled.

In some embodiments, the device 100 may comprise a tensioner 28 which may be configured to tension the wheel 13 into contact with the floor surface 600 that is below the door 500 to which the device 100 is coupled. A tensioner 28 may comprise any object or mechanical arrangement which may be used to store mechanical energy and use that mechanical energy to tension the wheel 13 into contact with the floor surface 600 that is below the door 500 to which the device 100 is coupled. For example, a tensioner 28 may be coupled to the slide 24 and to the channel 25 and configured to tension portions of the slide 24 and the channel 25 away from each other so that a wheel 13 that is coupled to the slide 25 may be tensioned to or against the floor surface 600 that is below the door 500 to which the device 100 is coupled.

In some embodiments, a tensioner 28 may comprise any type of spring such as a Tension/extension spring, Compression spring, Constant-force spring, Torsion spring, Variable spring, Coil spring, Flat spring, Machined spring, Serpentine spring, Cantilever spring, Hairspring or balance spring, Leaf spring, V-spring, Belleville washer or Belleville spring, Gas spring or gas piston, Mainspring, Negator spring, Progressive rate coil springs, Spring washer, Torsion spring, Wave spring, Rubber band, bungee cord, or other non-metallic elastic material, or any other material or device.

Figure 7:
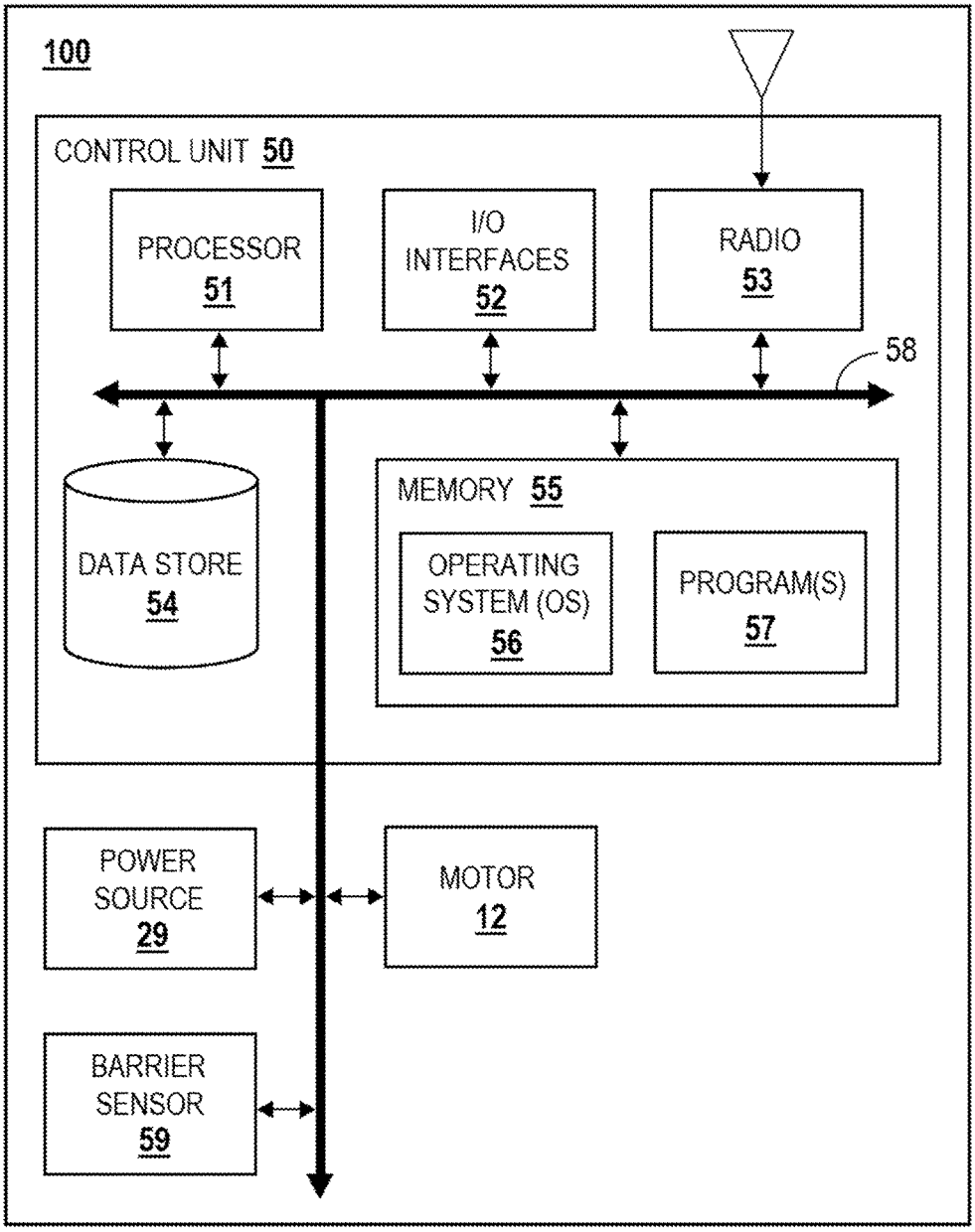
FIG. 7 depicts a block diagram of an example of an automatic door opening and closing device according to various embodiments described herein.

As perhaps best shown in FIGS. 2-7, the device 100 may comprise a control unit 50 which may be in electronic communication with the motor 12, and the control unit 50 may be configured to control the speed, direction, and/or ability of motor 12 to rotate the wheel 13. In some embodiments and in the present example, the device 100 can be a digital device that, in terms of hardware architecture, comprises a control unit 50 which optionally includes a processor 51, input/output (I/O) interfaces 52, a radio module 53, a data store 54, and memory 55. It should be appreciated by those of ordinary skill in the art that FIG. 7 depicts the device 100 in an oversimplified manner, and a practical embodiment may include additional components or elements and suitably configured processing logic to support known or conventional operating features that are not described in detail herein. The components and elements (50, 51, 52, 53, 54, 55, 29, 12, and 59) are communicatively coupled via a local interface 58. The local interface 58 can be, for example but not limited to, one or more buses, circuit boards, or other wired connections or wireless connections, as is known in the art. The local interface 58 can have additional elements, which are omitted for simplicity, such as controllers, buffers (caches), drivers, repeaters, and receivers, among many others, to enable communications. Further, the local interface 58 may include address, control, and/or data connections to enable appropriate communications among the aforementioned components.

The processor 51 is a hardware device for executing software instructions. The processor 51 can be any custom made or commercially available processor, a central processing unit (CPU), an auxiliary processor among several processors associated with the control unit 50, a semiconductor-based microprocessor (in the form of a microchip or chip set), or generally any device for executing software instructions. When the processing unit 50 is in operation, the processor 51 is configured to execute software stored within the memory 55, to communicate data to and from the memory 55, and to generally control operations of the device 100 pursuant to the software instructions and/or from instructions received from a remote control 70, translator 80, or a client device 400. In an exemplary embodiment, the processor 51 may include a mobile optimized processor such as optimized for power consumption and mobile applications.

The I/O interfaces 52 can be used to by a user to provide input, such as which may be used to control the speed and direction of the wheel 13, to the device 100 or to receive information, such as power levels or operational status, from the device 100. The I/O interfaces 52 can also include, for example, buttons, knobs, switches, LED indicator lights, LED display, LCD display, a serial port, a parallel port, a small computer system interface (SCSI), an infrared (IR) interface, a radio frequency (RF) interface, a universal serial bus (USB) interface, and the like.

A radio module 53 enables wireless communication to an external access device, such as to one or more remote controls 70, translators 80, other automatic door opening and closing devices 100, and client devices 400, or a network. In some embodiments, a radio module 53 may operate on with carrier frequencies such as are commonly used in commercially available RF modules, including those in the industrial, scientific and medical (ISM) radio bands such as 433.92 MHz, 915 MHz, and 2400 MHz and/or frequencies available for unlicensed use such as 315 MHz and 868 MHz. The radio module 53 may comply with a defined protocol for RF communications such as Zigbee, Bluetooth low energy, or Wi-Fi, or they may implement a proprietary protocol. Any number of suitable wireless data communication protocols, techniques, or methodologies can be supported by the radio module 53, including, without limitation: RF; IrDA (infrared); Bluetooth; ZigBee (and other variants of the IEEE 802.15 protocol); IEEE 802.11 (any variation); IEEE 802.16 (WiMAX or any other variation); Direct Sequence Spread Spectrum; Near-Field Communication (NFC); Frequency Hopping Spread Spectrum; Long Term Evolution (LTE); cellular/wireless/cordless telecommunication protocols (e.g. 3G/4G, etc.); wireless home network communication protocols; paging network protocols; magnetic induction; satellite data communication protocols; wireless hospital or health care facility network protocols such as those operating in the WMTS bands; GPRS; proprietary wireless data communication protocols such as variants of Wireless USB; and any other protocols for wireless communication.

An optional data store 54 may be used to store data. The data store 54 may include any of volatile memory elements (e.g., random access memory (RAM, such as DRAM, SRAM, SDRAM, and the like)), nonvolatile memory elements (e.g., ROM, hard drive, tape, CDROM, and the like), and combinations thereof. Moreover, the data store 54 may incorporate electronic, magnetic, optical, and/or other types of storage media.

The memory 55 may include any of volatile memory elements (e.g., random access memory (RAM, such as DRAM, SRAM, SDRAM, etc.)), nonvolatile memory elements (e.g., ROM, hard drive, etc.), and combinations thereof. Moreover, the memory 55 may incorporate electronic, magnetic, optical, and/or other types of storage media. Note that the memory 55 may have a distributed architecture, where various components are situated remotely from one another, but can be accessed by the processor 51. The software in memory 55 can include one or more software programs, each of which includes an ordered listing of executable instructions for implementing logical functions. In the example of FIG. 7, the software in the memory system 55 includes a suitable operating system (O/S) 56 and program(s) 57. The operating system 56 essentially controls the execution of input/output interface 52 functions, and provides scheduling, input-output control, file and data management, memory management, and communication control and related services. The operating system 56 may be, for example, LINUX (or another UNIX variant), Android (available from Google), Symbian OS, Microsoft Windows CE, Microsoft Windows 7 Mobile, iOS (available from Apple, Inc.), webOS (available from Hewlett Packard), Blackberry OS (Available from Research in Motion), and the like. The programs 57 may include various applications, add-ons, etc. configured to provide end user functionality with the device 100. For example, exemplary programs 57 may include, but not limited to, instructions for operating the motion of the wheel 13 such as automatically starting, stopping, and moving in a clockwise or counterclockwise direction. In a typical example, the end user typically uses one or more of the programs 57 control the motion of the wheel 13 via the motor 12 in order to open, close, or otherwise control the position, such as half open or half closed, of the door 500 to which the device 100 is coupled to.

Further, many embodiments are described in terms of sequences of actions to be performed by, for example, elements of a computing device. It will be recognized that various actions described herein can be performed by specific circuits (e.g., application specific integrated circuits (ASICs)), by program instructions being executed by one or more processors, or by a combination of both. Additionally, these sequence of actions described herein can be considered to be embodied entirely within any form of computer readable storage medium having stored therein a corresponding set of computer instructions that upon execution would cause an associated processor to perform the functionality described herein. Thus, the various aspects of the invention may be embodied in a number of different forms, all of which have been contemplated to be within the scope of the claimed subject matter. In addition, for each of the embodiments described herein, the corresponding form of any such embodiments may be described herein as, for example, "logic configured to" perform the described action.

The control unit 50 may also include a main memory, such as a random access memory (RAM) or other dynamic storage device (e.g., dynamic RAM (DRAM), static RAM (SRAM), and synchronous DRAM (SDRAM)), coupled to the bus for storing information and instructions to be executed by the processor 51. In addition, the main memory may be used for storing temporary variables or other intermediate information during the execution of instructions by the processor 51. The control unit 50 may further include a read only memory (ROM) or other static storage device (e.g., programmable ROM (PROM), erasable PROM (EPROM), and electrically erasable PROM (EEPROM)) coupled to the bus for storing static information and instructions for the processor 51.

In some embodiments, the device 100 may comprise a power source 29 which may provide electrical power to any component that may require electrical power. A power source 29 may comprise a battery, such as a lithium ion battery, nickel cadmium battery, alkaline battery, or any other suitable type of battery, a fuel cell, a capacitor, a super capacitor, or any other type of energy storing and/or electricity releasing device. In further embodiments, a power source 29 may comprise a power cord, kinetic or piezo electric battery charging device, a solar cell or photovoltaic cell, and/or inductive charging or wireless power receiver. In further embodiments, the device 100 may comprise a power charging and distribution module which may be configured to control the recharging of the power source 29, discharging of the power source 29, and/or distribution of power to one or more components of the device 100 that may require electrical power. In some embodiments, a power source 29 may be coupled, optionally removably coupled, to the chassis 14 or other element of the device 100 with one or more motor fastening devices, such as first power source harness 31 and a second power source harness 32, or via any other suitable coupling method.

In some embodiments, the device 100 may comprise a barrier sensor 59 which may receive input that may be provided to the control unit 50 to control the motion of the wheel 13 via the motor 12 in order to open, close, change direction or otherwise control the position or movement of a door 500 to which the device 100 is coupled. In further embodiments, a barrier sensor 59 may be in communication with the control unit 50, and the control unit 50 may control the motor 12 to cease rotation of the wheel 13 when the barrier sensor 59 detects movement of the door 500 to which the device 100 is coupled is being blocked. Preferably, a barrier sensor 59 may provide safety features or operate as a failsafe to prevent damage to the device 100, to the door 500, to a person, or to any other object in the path of the door 500 during operation of the device 100. In some embodiments, the barrier sensor 59 may detect contact between the device 100 or door 500 and the motor 12 may be operated to stop or reverse the movement of the door 500. In further embodiments, the barrier sensor 59 may detect an increase in the amount of torque being applied by the motor 12 and the motor 12 may be operated to stop or reverse the movement of the door 500. A barrier sensor 59 may comprise a torque sensor, electric safety edges, or any other type of sensor which may provide information to the control unit 50 to stop or reverse the movement of the door 500 so as to prevent damage to the floor surface 600, to objects, and to individuals should the ability of the door 500 to move be hindered.

Figure 8:
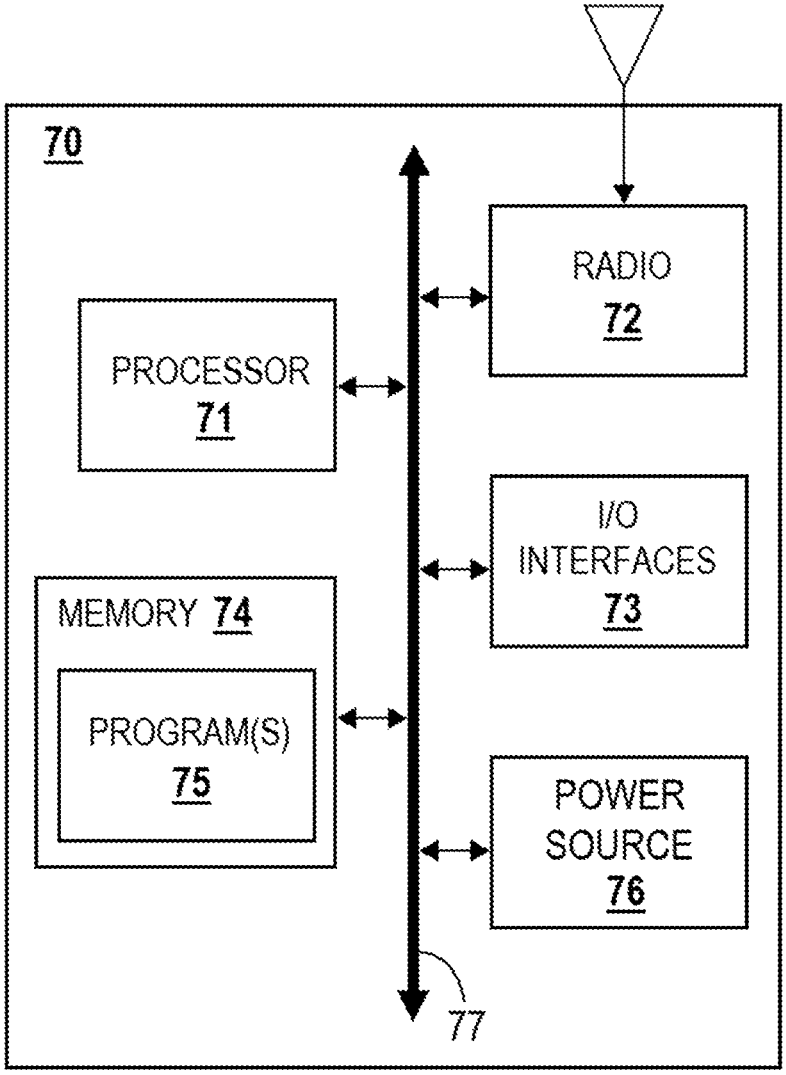
FIG. 8 illustrates a block diagram of an example of a remote control according to various embodiments described herein.

FIG. 8 illustrates a block diagram of an example of a remote control 70 which may be used to wirelessly control functions of the device 100 according to various embodiments described herein. In some embodiments, the device 100 may comprise a remote control 70 which may be in wired or wired communication with the control unit 50 to allow the remote control 70 to be used to control the speed, direction, and/or ability of motor 12 to rotate the wheel 13. In some embodiments and in the present example, the remote control 70 can be a digital device that, in terms of hardware architecture, may comprise a processor 71, a radio 72, input/output (I/O) interfaces 73, memory 74, programs 75, power source 76, and a local interface 77. It should be appreciated by those of ordinary skill in the art that FIG. 8 depicts the remote control 70 in an oversimplified manner, and a practical embodiment may include additional components or elements and suitably configured processing logic to support known or conventional operating features that are not described in detail herein. The components and elements (71, 72, 73, 74, 75, and 76) are communicatively coupled via a local interface 77. The local interface 77 can be, for example but not limited to, one or more buses, circuit boards, or other wired connections or wireless connections, as is known in the art.

The processor 71 is a hardware device for executing software instructions. The processor 71 can be any custom made or commercially available processor, such as a semiconductor-based microprocessor (in the form of a microchip or chip set), or generally any device for executing software instructions.

The I/O interfaces 73 can be used to by a user to provide input, such as which may be used to control the speed and direction of the wheel 13, to the device 100 or to receive information, such as power levels or operational status, from the device 100. The I/O interfaces 73 can also include, for example, buttons, knobs, switches, LED indicator lights, LED display, LCD display, a serial port, and the like.

A radio 72 enables wireless communication to an external access device, such as with one or more other remote controls 70, translators 80, automatic door opening and closing devices 100, client devices 400, or a network. In some embodiments, a radio 72 may operate on with carrier frequencies such as are commonly used in commercially available RF modules, including those in the industrial, scientific and medical (ISM) radio bands such as 433.92 MHz, 915 MHz, and 2400 MHz and/or frequencies available for unlicensed use such as 315 MHz and 868 MHz. The radio 72 may comply with a defined protocol for RF communications such as Zigbee, Bluetooth low energy, or Wi-Fi, or they may implement a proprietary protocol. Any number of suitable wireless data communication protocols, techniques, or methodologies can be supported by the radio 72, including, without limitation: RF; IrDA (infrared); Bluetooth; ZigBee (and other variants of the IEEE 802.15 protocol); IEEE 802.11 (any variation); IEEE 802.16 (WiMAX or any other variation); Direct Sequence Spread Spectrum; Near-Field Communication (NFC); Frequency Hopping Spread Spectrum; Long Term Evolution (LTE); cellular/wireless/cordless telecommunication protocols (e.g. 3G/4G, etc.); wireless home network communication protocols; paging network protocols; magnetic induction; satellite data communication protocols; wireless hospital or health care facility network protocols such as those operating in the WMTS bands; GPRS; proprietary wireless data communication protocols such as variants of Wireless USB; and any other protocols for wireless communication.

The memory 74 may include any of volatile memory elements (e.g., random access memory (RAM, such as DRAM, SRAM, SDRAM, etc.)), nonvolatile memory elements (e.g., ROM, hard drive, etc.), and combinations thereof. The software in memory 74 can include one or more software programs, each of which includes an ordered listing of executable instructions for implementing logical functions. In the example of FIG. 8, the software in the memory system 74 includes program(s) 75. The program(s) 75 may include various applications, add-ons, etc. configured to provide end user functionality with the device 100. For example, exemplary programs 75 may include, but not limited to, instructions for operating the motion of the wheel 13 such as automatically starting, stopping, and moving in a clockwise or counterclockwise direction. In a typical example, the end user typically uses one or more of the programs 75 control the motion of the wheel 13 via the motor 12 in order to open, close, or otherwise control the position, such as half open or half closed, of the door 500 to which the device 100 is coupled to.

A power source 76 may provide electrical power to the components of the remote control 70. A power source 76 may comprise a battery, such as a lithium ion battery, nickel cadmium battery, alkaline battery, or any other suitable type of battery, a fuel cell, a capacitor, a super capacitor, or any other type of energy storing and/or electricity releasing device.

Figure 9:
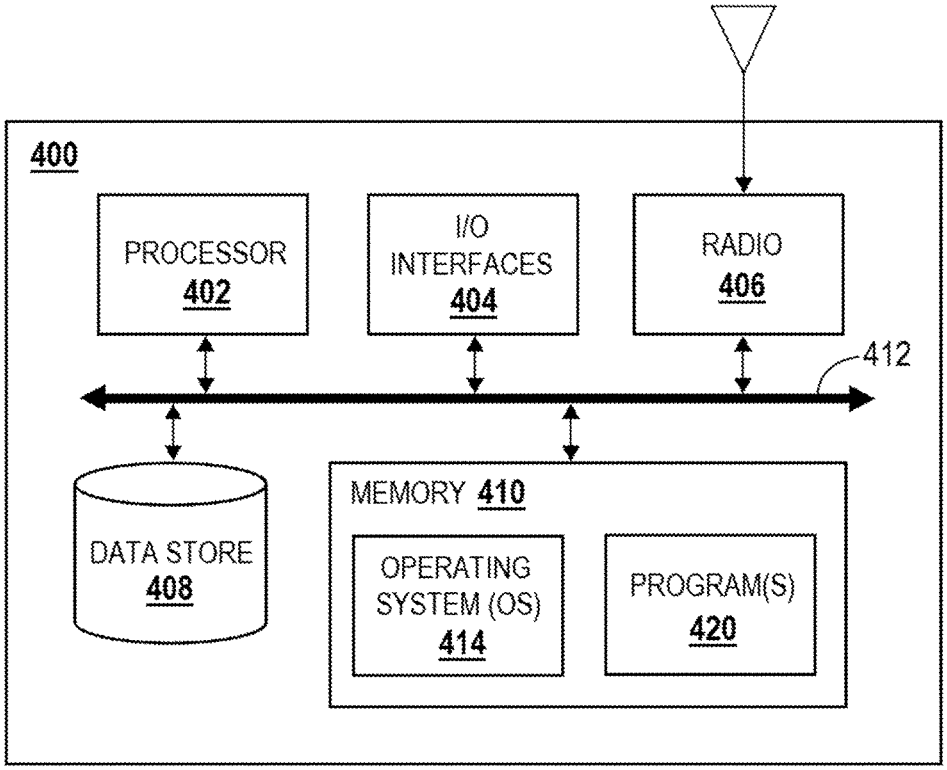
FIG. 9 shows a block diagram of an example of a client device according to various embodiments described herein.

Referring to FIG. 9, in an exemplary embodiment, a block diagram illustrates a client device 400 of which one or more may be used to wirelessly control functions of the device 100 and which may be a type of computing platform. Non-limiting examples of client devices 400 include: personal computers (PCs), workstations, laptops, tablet PCs including the iPad, cell phones including iOS phones made by Apple Inc., Android OS phones, Microsoft OS phones, Blackberry phones, digital music players, or any electronic device capable of running computer software and displaying information to a user, memory cards, other memory storage devices, digital cameras, external battery packs, external charging devices, and the like. Certain types of electronic devices which are portable and easily carried by a person from one location to another may sometimes be referred to as a "portable client device" or "portable device". Some non-limiting examples of portable client devices 400 include: cell phones, smartphones, tablet computers, laptop computers, wearable computers such as Apple Watch, other smartwatches, Fitbit, other wearable fitness trackers, Google Glasses, and the like.

The client device 400 can be a digital device that, in terms of hardware architecture, generally includes a processor 402, input/output (I/O) interfaces 404, a radio 406, a data store 408, and memory 410. It should be appreciated by those of ordinary skill in the art that FIG. 9 depicts the client device 400 in an oversimplified manner, and a practical embodiment may include additional components and suitably configured processing logic to support known or conventional operating features that are not described in detail herein. The components (402, 404, 406, 408, and 410) are communicatively coupled via a local interface 412. The local interface 412 can be, for example but not limited to, one or more buses or other wired or wireless connections, as is known in the art. The local interface 412 can have additional elements, which are omitted for simplicity, such as controllers, buffers (caches), drivers, repeaters, and receivers, among many others, to enable communications. Further, the local interface 412 may include address, control, and/or data connections to enable appropriate communications among the aforementioned components.

The processor 402 is a hardware device for executing software instructions. The processor 402 can be any custom made or commercially available processor, a central processing unit (CPU), an auxiliary processor among several processors associated with the client device 400, a semiconductor-based microprocessor (in the form of a microchip or chip set), or generally any device for executing software instructions. When the client device 400 is in operation, the processor 402 is configured to execute software stored within the memory 410, to communicate data to and from the memory 410, and to generally control operations of the client device 400 pursuant to the software instructions. In an exemplary embodiment, the processor 402 may include a mobile optimized processor such as optimized for power consumption and mobile applications.

The I/O interfaces 404 can be used to receive data and user input and/or for providing system output. User input can be provided via a plurality of I/O interfaces 404, such as a keypad, a touch screen, a camera, a microphone, a scroll ball, a scroll bar, buttons, bar code scanner, voice recognition, eye gesture, and the like. System output can be provided via a display screen 404A such as a liquid crystal display (LCD), touch screen, and the like. The I/O interfaces 404 can also include, for example, a global positioning service (GPS) radio, a serial port, a parallel port, a small computer system interface (SCSI), an infrared (IR) interface, a radio frequency (RF) interface, a universal serial bus (USB) interface, and the like. The I/O interfaces 404 can include a graphical user interface (GUI) that enables a user to interact with the client device 400. Additionally, the I/O interfaces 404 may be used to output notifications to a user and can include a speaker or other sound emitting device configured to emit audio notifications, a vibrational device configured to vibrate, shake, or produce any other series of rapid and repeated movements to produce haptic notifications, and/or a light emitting diode (LED) or other light emitting element which may be configured to illuminate to provide a visual notification.

The radio 406 enables wireless communication with an automatic door opening and closing device 100, remote control 70, translator 80, other client devices 400, a or network. Any number of suitable wireless data communication protocols, techniques, or methodologies can be supported by the radio 406, including, without limitation: RF; IrDA (infrared); Bluetooth; ZigBee (and other variants of the IEEE 802.15 protocol); IEEE 802.11 (any variation); IEEE 802.16 (WiMAX or any other variation); Direct Sequence Spread Spectrum; Frequency Hopping Spread Spectrum; Long Term Evolution (LTE); cellular/wireless/cordless telecommunication protocols (e.g. 3G/4G, etc.); wireless home network communication protocols; paging network protocols; magnetic induction; satellite data communication protocols; wireless hospital or health care facility network protocols such as those operating in the WMTS bands; GPRS; proprietary wireless data communication protocols such as variants of Wireless USB; and any other protocols for wireless communication.

The data store 408 may be used to store data and is therefore a type of memory. The data store 408 may include any of volatile memory elements (e.g., random access memory (RAM, such as DRAM, SRAM, SDRAM, and the like)), nonvolatile memory elements (e.g., ROM, hard drive, tape, CDROM, and the like), and combinations thereof. Moreover, the data store 408 may incorporate electronic, magnetic, optical, and/or other types of storage media.

The memory 410 may include any of volatile memory elements (e.g., random access memory (RAM, such as DRAM, SRAM, SDRAM, etc.)), nonvolatile memory elements (e.g., ROM, hard drive, etc.), and combinations thereof. Moreover, the memory 410 may incorporate electronic, magnetic, optical, and/or other types of storage media. Note that the memory 410 may have a distributed architecture, where various components are situated remotely from one another, but can be accessed by the processor 402. The software in memory 410 can include one or more software programs 420, each of which includes an ordered listing of executable instructions for implementing logical functions. In the example of FIG. 9, the software in the memory system 410 includes a suitable operating system (O/S) 414 and programs 420.

The operating system 414 essentially controls the execution of other computer programs, and provides scheduling, input-output control, file and data management, memory management, and communication control and related services. The operating system 414 may be, for example, LINUX (or another UNIX variant), Android (available from Google), Symbian OS, Microsoft Windows CE, Microsoft Windows 7 Mobile, Microsoft Windows 10, iOS (available from Apple, Inc.), webOS (available from Hewlett Packard), Blackberry OS (Available from Research in Motion), and the like.

The programs 420 may include various applications, add-ons, etc. configured to provide end user functionality with the client device 400. For example, exemplary programs 420 may include, but not limited to, a web browser, social networking applications, streaming media applications, games, mapping and location applications, electronic mail applications, financial applications, and the like. In a typical example, the end user typically uses one or more of the programs 420 to wirelessly control functions of the device 100.

FIG. 10 shows a block diagram of an example of a translator 80 which may be used to wirelessly control functions of the device 100 according to various embodiments described herein. Optionally, a translator 80 may receive a wireless signal 99 from a client device 400 and then output another wireless signal 99 to the device 100 to enable communication between the client device 400 and device 100 should the radios 53, 406, operate on different frequencies or with different communication protocols. In some embodiments, the device 100 may comprise a translator 80 which may be in wired or wired communication with the control unit 50 to allow a client device 400 to be used to control the speed, direction, and/or ability of motor 12 to rotate the wheel 13 by relaying or translating communication form the client device 400 to the control unit 50.

In some embodiments and in the present example, the translator 80 can be a digital device that, in terms of hardware architecture, may comprise a processor 81, a radio 82, input/output (I/O) interfaces 83, memory 84, programs 85, power source 86, and a local interface 87. It should be appreciated by those of ordinary skill in the art that FIG. 10 depicts the remote control 70 in an oversimplified manner, and a practical embodiment may include additional components or elements and suitably configured processing logic to support known or conventional operating features that are not described in detail herein. The components and elements (81, 82, 83, 84, 85, and 86) are communicatively coupled via a local interface 87. The local interface 87 can be, for example but not limited to, one or more buses, circuit boards, or other wired connections or wireless connections, as is known in the art.

The processor 81 is a hardware device for executing software instructions. The processor 81 can be any custom made or commercially available processor, such as a semiconductor-based microprocessor (in the form of a microchip or chip set), or generally any device for executing software instructions.

The optional I/O interfaces 83 can be used to by a user to provide input, such as which may be used to control the speed and direction of the wheel 13, to the device 100 or to receive information, such as power levels or operational status, from the device 100. The I/O interfaces 83 can also include, for example, buttons, knobs, switches, LED indicator lights, LED display, LCD display, a serial port, and the like.

A radio 82 enables wireless communication to an external access device, such as to one or more other remote controls 70, translators 80, automatic door opening and closing devices 100, client devices 400, or a network. In some embodiments, a radio 82 may operate on with carrier frequencies such as are commonly used in commercially available RF modules, including those in the industrial, scientific and medical (ISM) radio bands such as 433.92 MHz, 915 MHz, and 2400 MHz and/or frequencies available for unlicensed use such as 315 MHz and 868 MHz. The radio 82 may comply with a defined protocol for RF communications such as Zigbee, Bluetooth low energy, or Wi-Fi, or they may implement a proprietary protocol. Any number of suitable wireless data communication protocols, techniques, or methodologies can be supported by the radio 82, including, without limitation: RF; IrDA (infrared); Bluetooth; ZigBee (and other variants of the IEEE 802.15 protocol); IEEE 802.11 (any variation); IEEE 802.16 (WiMAX or any other variation); Direct Sequence Spread Spectrum; Near-Field Communication (NFC); Frequency Hopping Spread Spectrum; Long Term Evolution (LTE); cellular/wireless/cordless telecommunication protocols (e.g. 3G/4G, etc.); wireless home network communication protocols; paging network protocols; magnetic induction; satellite data communication protocols; wireless hospital or health care facility network protocols such as those operating in the WMTS bands; GPRS; proprietary wireless data communication protocols such as variants of Wireless USB; and any other protocols for wireless communication.

The memory 84 may include any of volatile memory elements (e.g., random access memory (RAM, such as DRAM, SRAM, SDRAM, etc.)), nonvolatile memory elements (e.g., ROM, hard drive, etc.), and combinations thereof. The software in memory 84 can include one or more software programs, each of which includes an ordered listing of executable instructions for implementing logical functions. In the example of FIG. 10, the software in the memory system 84 includes program(s) 85. The program(s) 85 may include various applications, add-ons, etc. configured to provide end user functionality with the device 100. For example, exemplary programs 85 may include, but not limited to, instructions for operating the motion of the wheel 13 such as automatically starting, stopping, and moving in a clockwise or counterclockwise direction. In a typical example, the end user typically uses one or more of the programs 85 to relay communication between the control unit 50 and a client device 400 to control the motion of the wheel 13 via the motor 12 in order to open, close, or otherwise control the position, such as half open or half closed, of the door 500 to which the device 100 is coupled to.

A power source 86 may provide electrical power to the components of the translator 80. A power source 86 may comprise a battery, such as a lithium ion battery, nickel cadmium battery, alkaline battery, or any other suitable type of battery, a fuel cell, a capacitor, a super capacitor, or any other type of energy storing and/or electricity releasing device.

Figure 11:
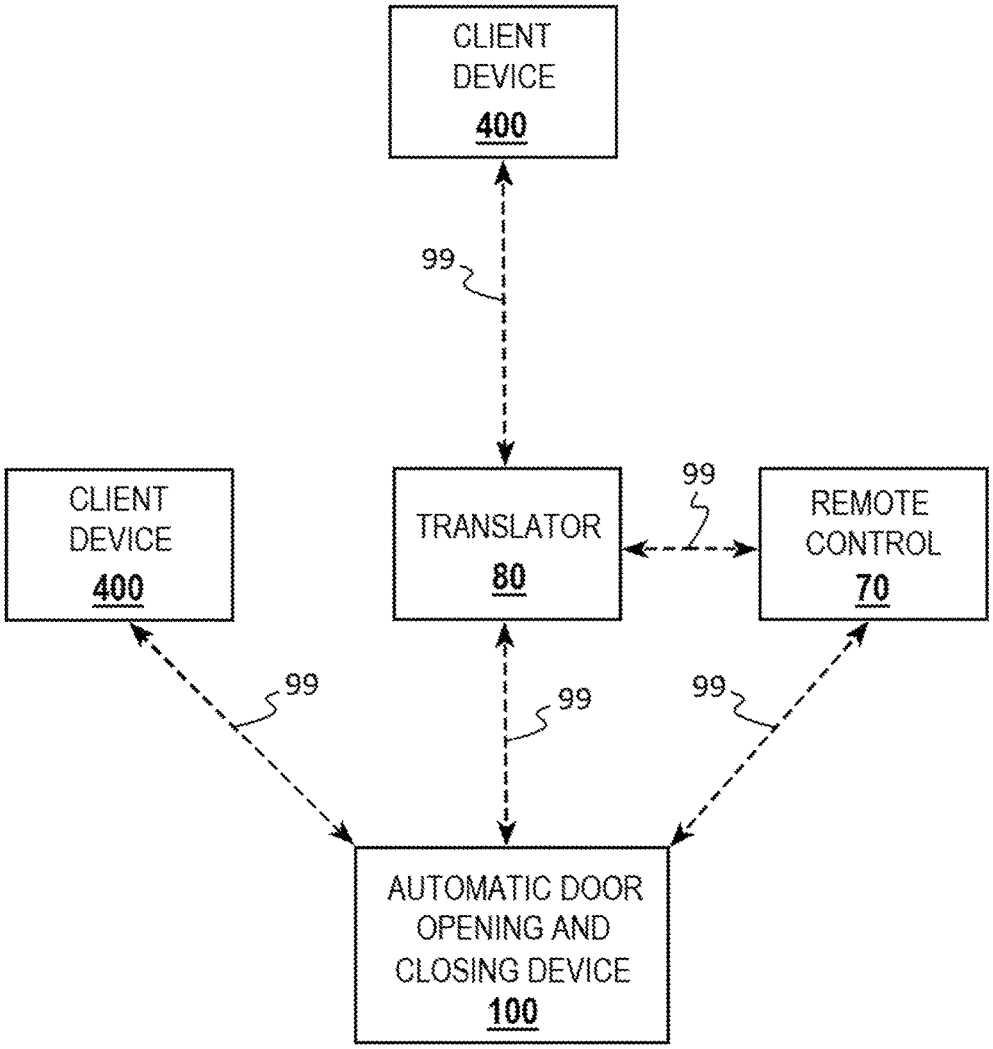
FIG. 11 illustrates a block diagram of an example of wireless communication between a remote control, translator, client device, and an automatic door opening and closing device according to various embodiments described herein.
Figure 12:
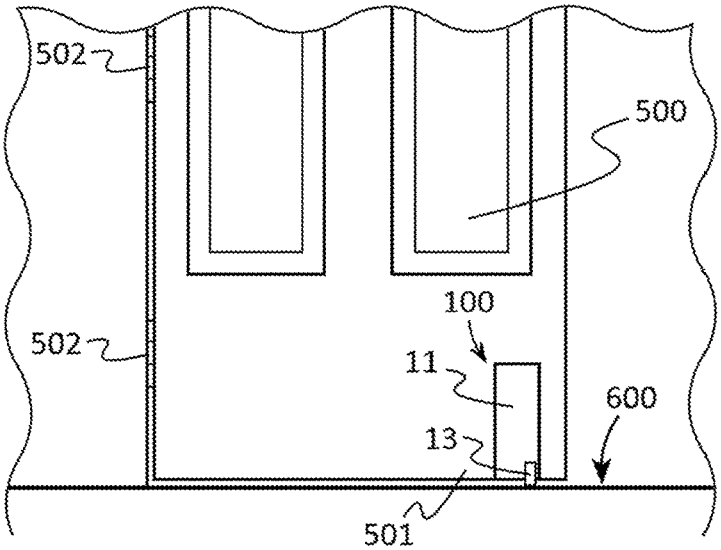
FIG. 12 shows an elevation view of an example of an automatic door opening and closing device coupled to a door according to various embodiments described herein.
Figure 13:
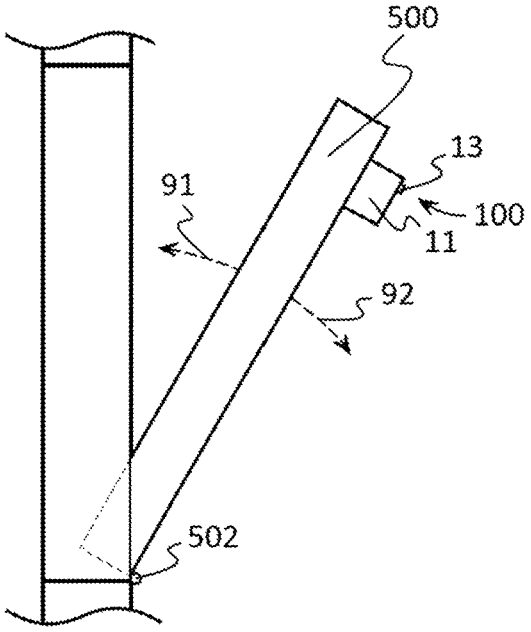
FIG. 13 depicts a top plan view of an example of an automatic door opening and closing device coupled to a door according to various embodiments described herein.

Turning now to FIGS. 11-13, the device 100 may be coupled to a door 500, proximate to the bottom 501 of the door 500 so that the wheel 13 may be in contact with the ground surface 600 below the door 500. The wheel 13 may rotate clockwise across the ground surface 600 to motivate the door 500 in a first direction 91, such as to close the door 500, and the wheel 13 may rotate counterclockwise across the ground surface 600 to motivate the door 500 in a second direction, such as to open the door 500. One skilled in the art will recognize that the first direction 91 and second direction 92 are merely different directions that a door 500 may be pivoted on hinges 502, such as a hinged door 500, or moved on a track, such as a sliding glass door 500, barn door 500, or the like, and that in other embodiments, a first direction 91 may generally be used to open the door 500 while a second direction 92 may generally be used to close the door 500. Additionally, the control unit 50 may control the motor 12 to cease rotation of the wheel 13. In some embodiments, the control unit 50 may control the motor 12 to cease rotation of the wheel 13 when the radio module 53 receives a wireless signal 99 from a client device 400, remote control 70, or translator 80. In further embodiments, the control unit 50 may control the motor 12 to cease rotation of the wheel 13 when a barrier sensor 59 detects movement of the door 500 by the device 100 is being blocked.

In some embodiments, the device 100 may comprise a remote control 70 configured to generate a wireless signal 99. In other embodiments, the device 100 may be in communication with a remote control 70 configured to generate a wireless signal 99. The control unit 50 may then control the motor 12 to rotate the wheel 13 when the radio module 53 receives the wireless signal 99 from the remote control 70. In this manner, the remote control 70 may cause the control unit 50 to be operable to control the motor 12 to stop the rotation of the wheel 13, to rotate the wheel 13 in a clockwise direction, and/or to rotate the wheel 13 in a counter clockwise direction. Optionally, information from the control unit 50 may be transmitted to the remote control 70 via the radios 53, 72, which may describe the movement of the wheel 13 or motor 12, the position of the door 500, the power level of the power source 29, if the barrier sensor 59 has directed the control unit and the motor 12 to cease rotation of the wheel 13, and/or any other information.

In some embodiments, the device 100 may be configured to review a wireless signal 99 generated by a client device 400. The control unit 50 may then control the motor 12 to rotate or stop rotating the wheel 13 when the radio module 53 receives the wireless signal 99 from the client device 400. In this manner, the client device 400 may cause the control unit 50 to be operable to control the motor 12 to stop the rotation of the wheel 13, to rotate the wheel 13 in a clockwise direction, and/or to rotate the wheel 13 in a counter clockwise direction. Optionally, information from the control unit 50 may be transmitted to the client device 400 via the radios 53, 406, which may describe the movement of the wheel 13 or motor 12, the position of the door 500, the power level of the power source 29, if the barrier sensor 59 has directed the control unit and the motor 12 to cease rotation of the wheel 13, and/or any other information.

In some embodiments, the device 100 may be in communication with a translator 80. In other embodiments, the device 100 may comprise a translator 80. A translator 80 may receive a wireless signal 99 from a client device 400 and then output another wireless signal 99 to the device 100 to enable communication between the client device 400 and device 100 should the radios 53, 406, operate on different frequencies or with different communication protocols. Similarly, a translator 80 may receive a wireless signal 99 from the device 100 and then output another wireless signal 99 to the client device 400 to enable communication between the client device 400 and device 100. Upon receiving a wireless signal 99 from the client device 400 via a translator 80, the control unit 50 may then control the motor 12 to rotate the wheel 13 when the radio module 53 receives the wireless signal 99 from the translator 80. In this manner, the client device 400, via the translator 80, may cause the control unit 50 to be operable to control the motor 12 to stop the rotation of the wheel 13, to rotate the wheel 13 in a clockwise direction, and/or to rotate the wheel 13 in a counter clockwise direction. Optionally, information from the control unit 50 may be transmitted to the client device 400 via the translator 80, which may describe the movement of the wheel 13 or motor 12, the position of the door 500, the power level of the power source 29, if the barrier sensor 59 has directed the control unit and the motor 12 to cease rotation of the wheel 13, and/or any other information.

While some materials have been provided, in other embodiments, the elements that comprise the device 100 such as the housing 11, wheel 13, chassis 14, optional remote control 70, optional translator 80, and/or any other element discussed herein may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. An automatic door opening and closing device, the device comprising:

a. a control unit, the control unit having a radio module;

b. a motor in electronic communication with the control unit;

c. a wheel coupled to the motor;

d. a chassis for coupling the motor to a door so that the wheel is in contact with a ground surface, wherein the motor is operable to rotate the wheel; and e. a translator in communication with the control unit, the translator comprising a processor, memory, and a power source, wherein the translator receives a first communication in a first protocol selected from one of; a Wi-Fi protocol, a Bluetooth protocol, and a Zigbee protocol, and translates the first communication into a second communication in a second protocol, the second protocol an infrared protocol, the second communication receivable by the radio module of the control unit.

2. The device of claim 1, wherein the wheel is movably coupled to the chassis.

3. The device of claim 2, further comprising a tensioner configured to tension the wheel into contact with the floor surface.

4. The device of claim 3, wherein the chassis comprises a slide movably coupled within a channel and the tensioner is coupled to the slide and channel to tension the slide and channel away from each other.

5. The device of claim 1, further comprising a barrier sensor in communication with the control unit, wherein the control unit controls the motor to cease rotation of the wheel when the barrier sensor detects movement of the door is being blocked.

6. The device of claim 1, wherein the control unit controls the motor to cease rotation of the wheel when the radio module receives a wireless signal.

7. The device of claim 1, further comprising a remote control configured to generate a wireless signal, wherein the control unit controls the motor the rotate the wheel when the radio module receives the wireless signal.

8. The device of claim 1, wherein the control unit controls the motor the rotate the wheel when the radio module receives a wireless signal from a radio of a client device.

9. The device of claim 1, further comprising a transmission configured to resist rotation of the wheel not caused by the motor.

10. An automatic door opening and closing device, the device comprising:

a. a control unit, the control unit having a radio module;

b. a motor in electronic communication with the control unit;

c. a wheel coupled to the motor;

d. a chassis for movably coupling the wheel to a door so that the wheel is in contact with a ground surface, wherein the motor is operable to rotate the wheel;

e. a transmission comprising a single stage gear reducer configured to resist rotation of the wheel not caused by the motor; the device further comprising a remote control configured to generate a wireless signal, wherein the control unit controls the motor to rotate the wheel when the radio module receives the wireless signal; and wherein the control unit controls the motor to rotate the wheel when the radio module receives a wireless signal from a radio of a translator, the translator comprising a processor, memory, and a power source, wherein the translator receives a first communication in a first protocol from the remote control and translates the first communication into a second communication in a second protocol, the second communication receivable by the radio module of the control unit, the first protocol being different from the second protocol.

11. The device of claim 10, wherein the wheel comprises a flexible material.

12. The device of claim 10, wherein the device comprises a power source.

13. The device of claim 12, further comprising a tensioner configured to tension the wheel into contact with the floor surface.

14. The device of claim 10, wherein the chassis comprises a slide movably coupled within a channel and a tensioner coupled to the slide and channel to tension the slide and channel away from each other.

15. The device of claim 10, further comprising a barrier sensor in communication with the control unit, wherein the control unit controls the motor to cease rotation of the wheel when the barrier sensor detects movement of the door is being blocked.

16. The device of claim 10, wherein the control unit controls the motor to cease rotation of the wheel when the radio module receives a wireless signal.

* * * * *